US006402863B1

(12) United States Patent
Spencer

(10) Patent No.: US 6,402,863 B1
(45) Date of Patent: Jun. 11, 2002

(54) HEAT TREATMENT FOR 9NI-4CO-0.30C TYPE STEELS

(75) Inventor: William R. Spencer, Longwood, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/558,226

(22) Filed: Apr. 26, 2000

(51) Int. Cl.[7] ..... C21D 6/04

(52) U.S. Cl. ..... 148/578; 148/621

(58) Field of Search ..... 148/578, 577, 148/621; 252/513, 521.2; 420/119

(56) References Cited

U.S. PATENT DOCUMENTS 3,645,721 A * 2/1972 Savas ..... 420/119
RE28,523 E * 8/1975 Hill et al. ..... 420/119
3,996,076 A * 12/1976 Tokuue et al. ..... 148/27
4,019,930 A * 4/1977 Aylward ..... 148/330

* cited by examiner

*Primary Examiner*—Roy King
*Assistant Examiner*—Harry D. Wilkins, III
(74) *Attorney, Agent, or Firm*—Burns, Doane, Swecker & Mathis, LLP

(57) ABSTRACT

A method of heat treating 9Ni-4Co-0.30C class steel alloy uses shortened treatment time for normalizing, austenitizing, and tempering, as well as a lower tempering temperature, when compared to conventional heat treatment for this class of alloy material. The improved process is especially beneficial for large section parts, resulting in increases in yield and ultimate strength, combined with substantial increases in impact toughness.

10 Claims, No Drawings

HEAT TREATMENT FOR 9NI-4CO-0.30C TYPE STEELS

BACKGROUND OF THE INVENTION

1. Field of the Invention

The present invention is directed to a method of heat treating 9Ni-4Co-0.30C class steel alloys. More particularly, the present invention is directed to a method of heat treating such alloys which uses shortened times for normalizing, austenitizing, and tempering steps, as well as a lowered tempering temperature when compared to existing heat treatments.

2. State of the Art

In the discussion of the state of the art that follows, reference is made to certain structures and/or methods. However, the following references should not be construed as an admission that theses structures and/or methods constitute prior art. Applicant expressly reserves the right to demonstrate that such structures and/or methods do not qualify as prior art against the present invention.

Existing heat treatments for 9Ni-4Co-0.30C class steel alloys, such as AMS 6526, AMS 6524, ASTM A579, and MIL-H-6875, prescribe heat treatments which employ long "time at temperature" periods for normalizing, austenitizing, and tempering of the alloys. This is especially true when heat treating a part or body made from the above-mentioned alloys, at least a portion of which having a relatively large sectional thickness. Generally, the above-mentioned heat treatments require approximately 1 additional hour of hold time to be added for each inch in part sectional thickness. For parts having regions with different sectional thicknesses, the times for heat treatment must be calculated based upon the maximum sectional thickness possessed by any portion of the part being treated.

It has been determined that application of existing heat treatments to parts made from 9Ni-4Co-0.30C class steel alloys, at least a portion of which having a relatively large sectional thickness, will in many cases fail to give the necessary strength and toughness properties necessary for certain high performance applications.

Existing heat treatments for 9Ni-4Co-0.30C class steel alloys-generally include a normalizing step comprising treating the alloy at a temperature of approximately 1650° F. for 1 hour per every 1 inch in sectional thickness, and austenitizing step comprising treating the alloy at a temperature of approximately 1550° F. for a period of 1 hour per every inch of sectional thickness of the part or body formed from the alloy, and a tempering step which comprises treating a body or part formed from the alloy at a temperature of approximately 1000° F. for 2 hours plus an additional 1 hour for every inch of sectional thickness of the part or body.

SUMMARY OF THE INVENTION

It is an object of the present invention to overcome these and other problems associated with existing heat treating methods for 9Ni-4Co-0.30C steel alloys. Generally speaking, the present invention comprises a method of heat treating the above-mentioned alloys which utilizes shorter treatment times for the normalizing, austenitizing and tempering steps, as well as a lowered tempering temperature, when compared to the treatment times and tempering temperature of existing recommended heat treatments for this particular class of alloys.

In one aspect, the present invention provides a method of treating a steel body having a sectional thickness comprising the steps of (i) normalizing the steel body at a temperature of approximately 1650° F. over a period of approximately 1–4 hrs.; (ii) austenitizing the steel body at a temperature of approximately 1550° F. over a period of 1–3 hrs.; (iii) quenching the steel body from the temperature of approximately 1550° F.; (iv) cooling and holding the steel body to a temperature of minus 100° F. for a period of at least approximately 2 hrs.; and (v) tempering the steel body at a temperature of approximately 975° F. for a period of approximately 2–3 hrs., cooling the steel body to ambient, then tempering the steel body again at a temperature of approximately 975° F. for a period of approximately 2–3 hrs.

DETAILED DESCRIPTION OF THE PREFERRED EMBODIMENTS

A heat treatment conducted consistent with the principles of the present invention generally includes the steps of normalizing a steel alloy, austenitizing the steel alloy, and subsequently tempering the steel alloy in a manner which prevents deterioration of the tensile yield and ultimate strength, as well as the Charpy V-notch impact toughness.

In the following description, the described alloy "time at temperature" can be determined by utilizing a section of part made from the alloy material of similar geometrical configuration to that of the part being treated, with a thermocouple embedded in the center of the section thickness for each heat treatment run. In this manner, an accurate determination of the temperature of the part can be determined.

The normalizing step of the present invention comprises treating a steel alloy for 1–4 hours at a temperature approximately 1650° F. The austenitizing step of the present invention comprises treating a steel alloy for a period of 1–3 hours at a temperature approximately 1550° F. The tempering step of the present invention comprises treating a steel alloy for a period of 2–3 hours at a temperature approximately 975° F.

It should be noted that the above-mentioned temperatures are approximate and can vary within acceptable tolerance ranges. Moreover, these temperatures may be slightly varied by one of ordinary skill in the art depending upon various factors, such as the size and number of parts being treated, the particular grade of steel alloy being treated, as well as the complexity of the sectional shape of the parts being treated.

The heat treatment process of the present invention is particularly useful when utilized to treat alloys of the 9Ni-4Co-0.30C class. More particularly, the heat treatment process of the present invention is especially useful in treating parts or bodies made from this class of steel alloy material, particularly when at least a portion of the part possesses a relatively large sectional thickness. In preferred aspects, the heat treatment process of the present invention can be utilized to treat bodies having at least a portion of which possesses a sectional thickness of 3 inches or more. In a further preferred aspect of the present invention, the heat treatment process can be utilized to treat a body or part made from the above-mentioned steel alloy, at least a portion of which possesses a sectional thickness of 8 inches or more. It is expected that the process of the present invention could be utilized to heat treat a number of different kinds of steel alloy parts or bodies.

For example, the heat treatment process of the present invention can be utilized generally to treat a warhead casing which generally comprises an elongated tubular body with a partly solid ogive-shaped nose section. The maximum sectional thickness of the warhead casing is about 8 inches at the solid nose portion thereof, while the elongated tubular body section has a wall thickness of approximately 3 inches.

By way of example, the above-described casing was normalized at a temperature of approximately 1650° F. for a period of approximately 4 hours in a neutral atmosphere. The casing was then allowed to air cool until an ambient temperature was reached. The case was then austenitized at a temperature of approximately 1550° F. for a period of approximately 2 hours. The casing was then quenched in a large, strongly agitated tank of water or of a solution of water and 5–7% aqueous polymer solution. The water or aqueous polymer solution was at ambient temperature. The part was submerged in the tank for at least 1 hour. Within 2 hours of being removed from the quench tank, the casing is then subjected to an austenite-transformation treatment which comprises cooling the casing to a temperature of approximately −100° F. and holding the casing at that temperature for a minimum of 2 hours. The casing is then subjected to a double temper treatment. The casing was treated at a temperature of approximately 975° F. for a period of approximately 3 hours in a neutral atmosphere. The casing was then cooled to ambient temperature by either air cooling or water quenching. The above-described tempering step was then repeated (i.e.-again heating the casing to approximately 975° F., for a period of approximately 3 hours in a neutral atmosphere, followed by air cooling or water quenching to ambient).

Through application of the above-described heat treatment according to the principles of the present invention, it was surprisingly found that, despite the shorter treatment times and lower tempering temperature, parts made from 9Ni-4Co-0.30C class steel alloys possessed superior tensile yield, ultimate strength, and Charpy V-notch impact toughness when compared to parts treated by existing prescribed heat treatments.

For example, parts having a sectional thickness of approximately 3 inches made from the above-mentioned class of alloy material treated in accordance with the principles of the present invention exhibited an approximate 7% increase in tensile yield and ultimate strengths, as well as an approximate 20% increase in Charpy V-notch impact toughness at ambient temperature, and an approximately 36% increase in Charpy V-notch impact toughness at a temperature of −40° F.

Not only did the parts treated according to the principles of the present invention exhibit improved properties, but significant time saving in the treatment process were also realized. For example, normalizing the above-mentioned warhead casing which has a maximum sectional thickness of 8 inches according to existing techniques would take approximately 8 hours (i.e.–1 hour per inch of sectional thickness). By comparison, the normalizing step of the present invention is limited to approximately 4 hours. Austenitizing the above-mentioned casing according to conventional techniques would also take approximately 8 hours (i.e.–1 hour per inch of sectional thickness). By comparison, the austenitizing step of the present invention is limited to 2 hours for a part having a maximum 8-inch sectional thickness.

Tempering the above-mentioned casing according to conventional techniques would take approximately 10 hours (i.e.–2 hours plus 1 hour per inch of sectional thickness). By contrast, the tempering step of the present invention is limited to 3 hours for a part having a maximum sectional thickness of 8 inches. Moreover, the tempering step according to conventional techniques is conducted at a temperature of 1000° F. By contrast, the tempering step carried out according to the principles of the present invention at a reduced temperature of 975° F., thereby providing the added benefit of energy savings.

Although the present invention has been described by reference to particular embodiments, it is in no way limited thereby. To the contrary, modifications and variants will be apparent to those skilled in the art in the context of the following claims.

We claim:

1. A method of treating a 9Ni-4Co-0.30C class steel body, at least a portion of the body having a sectional thickness of at least 3 inches, comprising the steps of:

(i) normalizing the steel body at a temperature of approximately 1650° F. for a period of approximately 1–4 hrs.;

(ii) austenitizing the steel body at a temperature of approximately 1550° F. for a period of 1–3 hrs.;

(iii) quenching the steel body from the temperature of approximately 1550° F.;

(iv) cooling and holding the steel body to a temperature of minus 100° F. for a period of at least approximately 2 hrs.; and (v) tempering the steel body at a temperature of approximately 975° F. for a period of approximately 2–3 hrs., cooling the steel body to ambient, then tempering the steel body again at a temperature of approximately 975° F. for a period of approximately 2–3 hrs.

2. The method of claim 1, wherein the period in step (i) is approximately 4 hrs., the period in step (ii) is approximately 2 hrs., and the period in step (v) is approximately 3 hrs.

3. The method of claim 2, wherein the sectional thickness is at least 8 inches.

4. The method of claim 1, wherein step (i) further comprises cooling the steel body to the ambient temperature in air.

5. The method of claim 1, wherein step (iii) further comprises quenching the steel body in agitated water at room temperature for at least 1 hr.

6. The method of claim 1, wherein step (iii) further comprises quenching the steel body in an agitated solution comprising water and 5–7% polymer at ambient temperature for at least 1 hr.

7. The method of claim 1, wherein step (v) further comprises cooling the steel body in air.

8. The method of claim 1, wherein step (v) further comprises cooling the steel body in water.

9. The method of claim 1, further comprising providing the steel body with a composition comprising 9 wt. % Ni, 4 wt. % Co, and 0.30 wt. % C.

10. The method of claim 1, further comprising providing the steel body with a configuration comprising a warhead casing.

* * * * *